United States Patent [19]

Wiatr et al.

[11] 4,121,766

[45] Oct. 24, 1978

[54] RAILWAY TIE COLLAR

[76] Inventors: Rudolph F. Wiatr, 5525 N. Chester, Chicago, Ill. 60656; John R. Sigle, R.R. 1, Pawnee, Ill. 62558

[21] Appl. No.: 876,755

[22] Filed: Feb. 10, 1978

Related U.S. Application Data

[63] Continuation-in-part of Ser. No. 708,201, Jul. 23, 1976, abandoned.

[51] Int. Cl.[2] ..... E01B 3/24

[52] U.S. Cl. ..... 238/110; 238/109; 238/300

[58] Field of Search ..... 238/109, 110, 111, 114, 238/115, 116, 117, 119, 300

[56] References Cited

U.S. PATENT DOCUMENTS

| | | | |
|---|---|---|---|
| 97,224 | 11/1869 | Phillips | 238/110 |
| 505,478 | 9/1893 | Perrody | 238/111 |
| 694,276 | 2/1902 | Hickok | 238/110 |
| 963,844 | 7/1910 | Winn | 238/110 |
| 1,026,341 | 5/1912 | Burch | 238/110 |
| 1,031,177 | 7/1912 | Goble | 238/110 |
| 2,656,115 | 10/1953 | Sonneville | 238/117 |

FOREIGN PATENT DOCUMENTS

| | | | |
|---|---|---|---|
| 1,614 of | 1863 | United Kingdom | 238/111 |

*Primary Examiner*—Randolph A. Reese
*Attorney, Agent, or Firm*—Gary, Juettner & Pyle

[57] ABSTRACT

A track supporting railway tie collar includes an upper receptacle for slidably and loosely receiving an end portion of a cross tie and a lower enlarged portion supported in the ballast beneath the track structure. The collar serves to transfer the weight of the train directly to the ground, rather than through the tie, thereby greatly prolonging the life of the tie and minimizing track maintenance.

11 Claims, 7 Drawing Figures

Fig. 5.
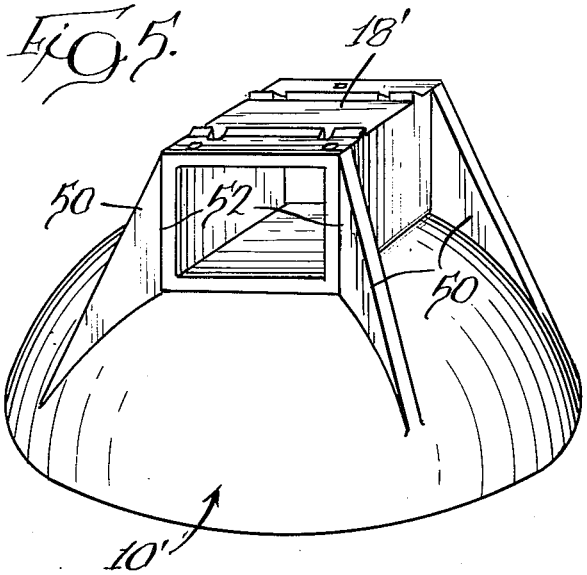
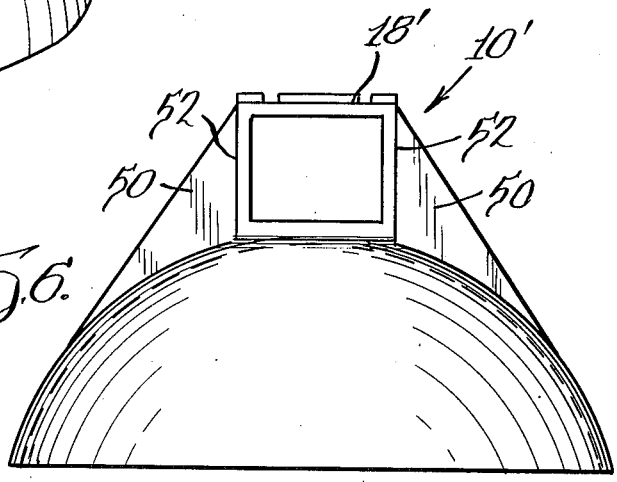
Fig. 6.
Fig. 7.
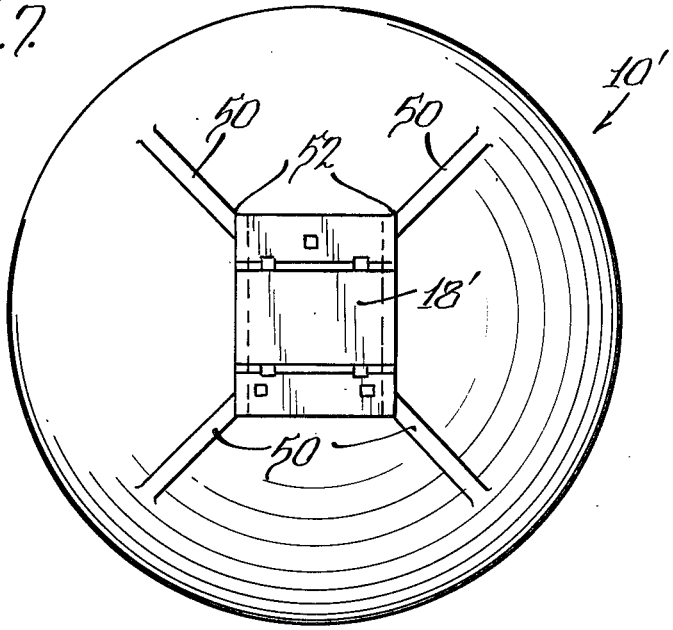

RAILWAY TIE COLLAR

CROSS REFERENCE

This is a continuation-in-part of copending application Ser. No. 708,201, filed July 23, 1976, now abandoned.

BACKGROUND OF THE INVENTION

In accordance with conventional practice, railway track structure comprises a bed of ballast, a plurality of equi-spaced wooden cross ties resting on the ballast, and a pair of parallel rails secured to and supported on the upper surface of the ties. The rails are fastened to the ties by means of spikes or other conventional retainers.

When a section of railway track is subjected to traffic, the repeated passage and weight of the train causes the underlying ballast, usually composed of gravel, to become displaced under portions of the ties. In most instances, the ballast directly beneath the rails and the ends of the ties will be displaced more than the ballast near the center of the ties. In such a case, greater stress is placed on the center of the tie, which may cause the tie to crack in the middle. In other instances, the weight of the train causes the end of the tie to become split or cracked, thereby seriously weakening the track structure. Proper track maintenance requires that cracked or split ties be replaced with regularity, which is a costly and time consuming process.

The laying of track according to the conventional procedure is complicated by the need to obtain as much uniformity as possible. Particularly, the uniform spacing of the ties is critical, and time consuming measurement procedures must be utilized.

Typical rail and tie support arrangements in the prior art include rigid concrete structures as well as metallic pedestals for supporting a rail, wherein the tie is either clamped within or otherwise rigidly affixed to the pedestal. These arrangements are inadequate to overcome the problem of deterioration of the cross tie or concrete support, since the vertical flexing of the rail during passing of the train tends to concentrate stresses in these rigid structures. In the case of the pedestal, vertical movements on the rail may cause undue compression of the tie, displacement of ballast and lifting of the pedestal from the ballast. In the case of these rigid concrete structures, cracking and failure has been encountered.

SUMMARY OF THE INVENTION

In accordance with the present invention, a track support structure is characterized by a novel tie collar, which slidably and loosely receives the end portion of the tie and yet provides direct support for the track, thus minimizing stress on the tie. The collar is preferably of one piece rigid construction and includes an upper receptacle or cavity having opposite open sides, through which the end of the tie is received and a lower enlarged portion for engaging within the ballast. The rail is mounted on the upper portion, and the weight of the train is transferred directly to the lower portion and to the ballast. The tie collar is attached to the tie in such a manner as to allow vertical movements of the collar and tie relative to one another, while substantially preventing horizontal movements therebetween. This allows the structure to accommodate severe vertical compressive and lifting forces caused by passage of the train, while the tie serves primarily as a means to retain gauge between the rails. This minimizes ballast displacement by the tie and relieves end compression on the tie, while providing increased and more uniform support for weight distribution.

Preferably, the lower portion of the collar is flared outwardly from the upper portion in the form of a hollow semi-sphere. As the track is being laid, adjacent collars are arranged with their lower portions in contact or closely and uniformly spaced, thus automatically providing uniform spacing between adjacent ties.

As a result of the tie collar of the present invention, the ties serve primarily to maintain the gauge of the rail and are not subjected to high compressive forces, thereby vastly increasing the service life of the tie and greatly reducing maintenance requirements for the track.

The tie collar of the present invention affords further substantial improvements which will be hereinafter described in detail.

THE DRAWINGS

FIG. 5 is a perspective view of an alternative version of the novel tie collar.

FIG. 6 is a side view of the collar shown in FIG. 5.

FIG. 7 is a plan view of the collar shown in FIG. 5.

DESCRIPTION OF THE PREFERRED EMBODIMENTS

Figure 3:
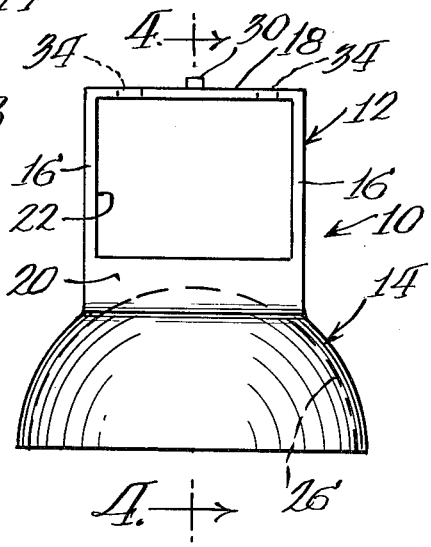
FIG. 3 is a side view of the novel tie collar.
Figure 4:
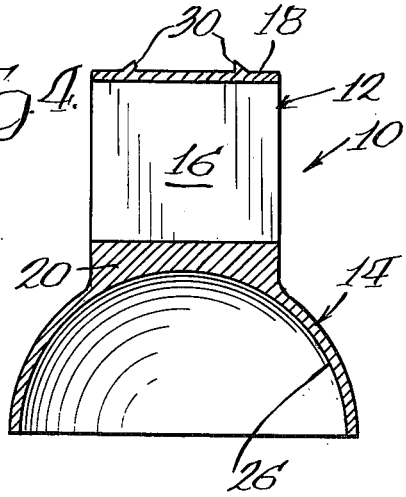
FIG. 4 is a vertical sectional view of the collar, taken along section line 4—4 of FIG. 3.

Referring first to FIGS. 3 and 4, the tie collar of the present invention, generally indicated at 10, comprises an upper tie receiving portion 12 and a lower enlarged ground engaging portion 14. The collar 10 is preferably of rigid unitary construction and may be fabricated from metal such as cast iron or steel by ordinary methods.

Figure 2:
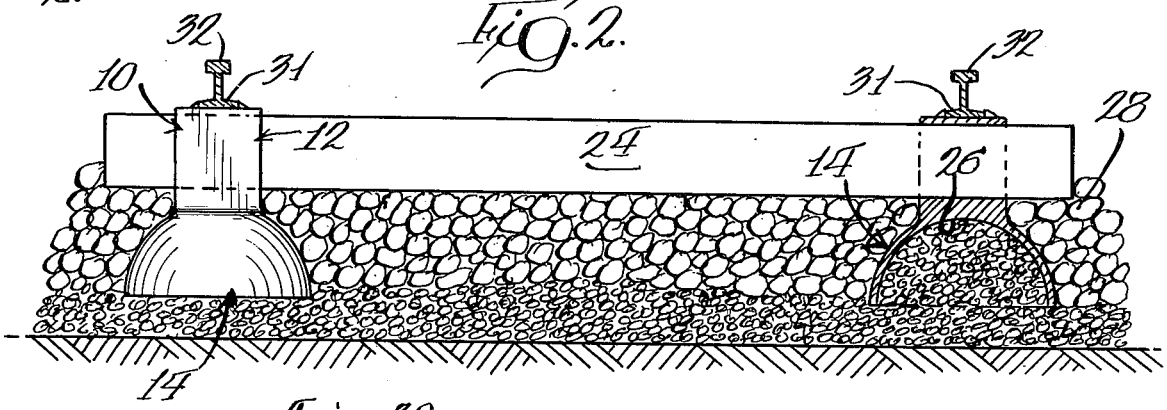
FIG. 2 is a transverse sectional view taken along section line 2—2 of FIG. 1.

As shown, the upper portion 12 is in the form of a square or rectangular box having open sides and comprising a pair of spaced parallel side walls 16 connected by top 18 and bottom 20 walls. The cavity or receptacle 22 through the upper portion is sufficiently large to slidably and loosely receive one end of a tie 24 as shown in FIG. 2, with the tie extending entirely through and slightly beyond the opening. The receptacle 22 is preferably rectangular to receive a conventional rectangular wooden tie 24, but it will be appreciated that the receptacle could be shaped to accommodate any type, size, and shape of tie. In any event, the size of the receptacle in portion 12 and/or the outside dimensions of the tie 24 is selected to allow the tie to be received somewhat loosely in the receptacle, rather than in a snug or clamped fashion as has been prevalent in the prior art.

Figure 1:
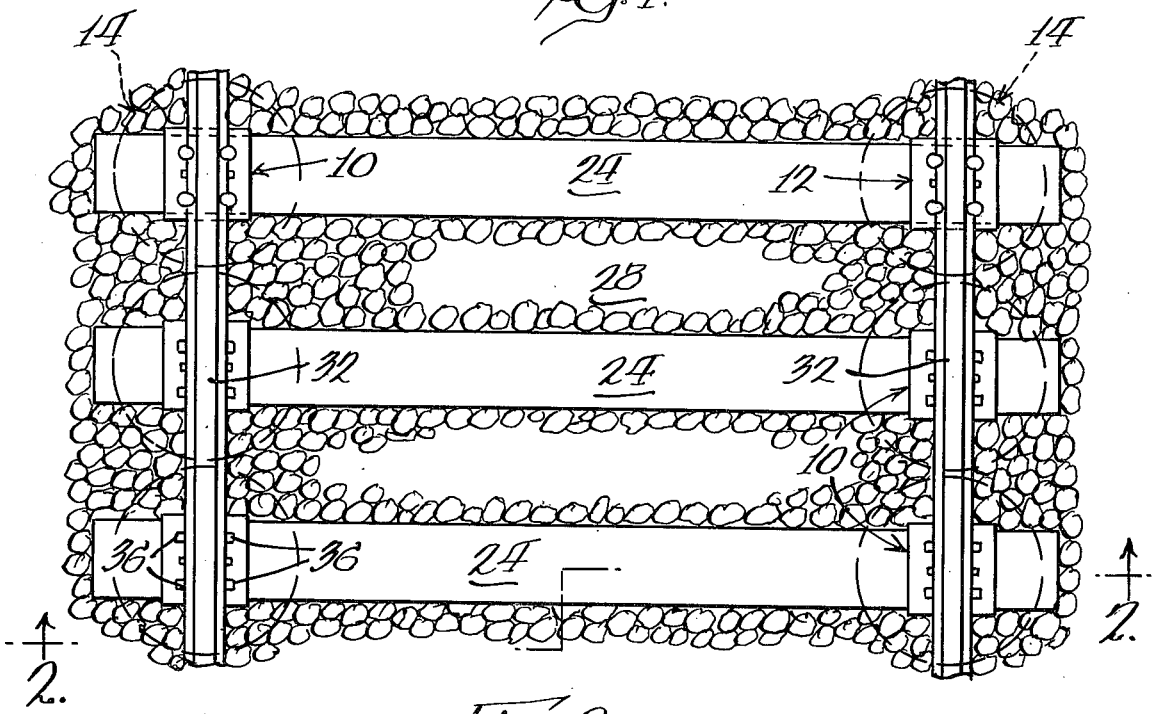
FIG. 1 is a plan view of a section of railway track utilizing the novel tie collar of the present invention.

The lower portion 14 diverges outward from the upper portion 12 and provides a relatively large surface for engaging within the ballast as shown in FIGS. 1 and 2. As shown, the lower portion 14 is preferably in the form of a hollow portion of a semi-sphere, with the concave surface 26 thereof facing downward. When installed, as shown in FIGS. 1 and 2, the lower portion 14 is substantially submerged in the ballast 28, which may be the usual crushed rock, gravel, or the like. In addition, it will be noted that the ballast 28 substantially fills the downwardly facing concave or cup shaped interior of the lower portion. Although the lower portion is shown in the form of a semi-sphere, it will be apparent that other equivalent forms could be used, such as a cone section, pyramid, cube or parallelepiped. The base of the lower portion is substantially greater in diameter or area than the width or area of the upper portion.

As best shown in FIG. 2, the lower portion 14 presents a downwardly facing surface that tends to entrap, rather than displace, the ballast under vertical downward loadings while at the same time providing excellent lateral restraint. In addition, the lower portion presents an upwardly facing surface that is capable of preventing uplifting of the collar.

The top wall 18 of the upper portion 12 includes a pair of spaced flanges 30 defining a longitudinal channel for receiving the base flange 31 of a railway rail 32. A plurality of openings 34 are also provided in longitudinal alignment with the flanges for receiving conventional spikes 36, which are driven through the openings and into the tie 24, such that the heads of the spikes overlap the rail flange 31 and retain the rail in position. The spikes 36 thus serve to retain the rail 32 in position and also serve to secure the tie 24 relative to the collar 10 providing a means for securing the tie and collar in a fixed horizontal position while allowing the tie and collar to move relative to each other in a vertical direction. When upward forces occur the rail is free to move in the flanges and away from the upper surface of the tie collar by virtue of the spiking, and the vertical clearance between the tie and the tie receiver, thus, relieving the vertical stress and allowing the tie collar unit to remain fixed in the ballast. This fastening arrangement provides sufficient horizontal gauging constraints to the track structure. Obviously, separate means could be employed to secure the rail and tie to the tie collar as aforesaid. For example, spikes could be driven through the top wall of the upper portion 12, and the rail could be separately retained by conventional clips or other means secured to the top wall.

The manner of attaching the tie collar to the tie is important to the purposes of the present invention. At least a minimal vertical clearance is provided between the tie and the inside cavity of the upper portion, and any securement means employed between the collar and the tie should allow at least minimal free play therebetween. Spikes driven through apertures in the top wall will allow the top wall of the collar to flex downward without crushing the tie and will also allow limited vertical movements between the collar and tie. This limited play allows the tie to be substantially unaffected by compression or lifting of the rail or slight movements or flexing of the collar. Obviously, other securement means could be employed to accomplish the same result, such as, for example, a rod, bolt or spike passing through apertures in the side walls of the receptacle, the apertures being sized to allow vertical free play.

It will also be appreciated that if conventional spikes are driven through the receptacle top wall, such spikes will loosen somewhat under service conditions, but this will not affect the safety or benefits of the structure. As an additional safety feature, in the event that the top wall of the collar fails at the corners, the load will still be borne by the tie until a repair can be effected.

In order to lay the track, the bed comprising the ballast 28 is prepared with the lower portion 14 of the collar embedded therein, as shown in FIG. 2. As shown in FIG. 1, the collars are disposed in parallel lines with the bases either in tangential contact or with equal spacing therebetween, thereby assuring equal spacing between adjacent ties without need for measurement.

Preferably, a plurality of units each consisting of a tie 24 and a pair of spaced collars 10 are prepared. Such units may be very simply brought to the construction site and emplaced in an adjacent abutting relation, as shown with the rail 32, thereafter being installed with spikes or other retainers. If used anti-creep devices may be attached to the track next to the upper tie receiver. The contact distance between the ties which is determined by the lower bell housing will not need to be increased to accommodate the anti-creep devices.

Another embodiment of the collar 10[1] is shown in FIG. 5–7. The collar therein shown is substantially identical to the one shown in FIGS. 1–4 but is additionally provided with reinforcing webs 50 extending from each corner edge 52 of the upper portion 12 to the outer surface of the lower portion 14.

The webs 50 may be formed during the casting of the collar and primarily serve to increase the rigidity and strength of the unit against vertical forces. Also, it will be noted that the webs 50 extend entirely to the top wall 18[1], thus providing added support for such wall.

It may be seen that the railway tie collar of the present invention offers substantial advantages over conventional track constructions. First, the upper portion 12 does not grip, yet entirely surrounds and protects the end of the tie, thereby eliminating or greatly minimizing cracking and failure of the end of the tie due to compressive forces. In fact, the ties may be spaced above the level of the bed or only in light engagement therewith, since they serve primarily to maintain the correct distance between the rails. Second, the enlarged lower portion 14 provides a large surface area of ground support. The lower portion is embedded below the surface of the ballast and due to its large surface area and position, minimizes displacement of ballast and consequent cracking of ties in the middle. The track system utilizing the collar of the present invention thus requires less maintenance, fewer repairs and replacement of ties, and tends to remain more level and stable than current track constructions. Furthermore, uniform spacing and load distribution is inherently provided with the contacting or equally spaced arrangement of adjacent collars.

It will be apparent that various modifications in the design and construction of the tie collars described herein may be made without departing from the scope of the invention defined in the claims appended hereto.

We claim:

1. A railway tie collar for supporting a rail over spaced ties and ballast, said tie collar comprising a unitary rigid structure having an upper portion and lower portion, said upper portion comprising an upper wall for supporting a rail and a pair of side walls extending between said top wall and said lower portion, and a cavity through said upper portion between said top and side walls, said cavity being dimensioned to loosely and slidably receive each tie near each end portion thereof, whereby vertical forces on the tie collar are substantially borne by the tie collar, thereby minimizing wear and stress on said tie, said lower portion being flared outwardly from the upper portion and being of sufficient length to engage within said ballast.

2. The tie collar of claim 1 further comprising attachment means for securing said upper portion to a tie to prevent horizontal movement while allowing vertical movement therebetween.

3. The tie collar of claim 2 wherein said attachment means is provided through the top wall of said tie collar.

4. The tie collar of claim 1 wherein said lower portion has a downwardly facing concave surface.

5. The tie collar of claim 4 wherein said concave surface is in the form of a hollow portion of a semisphere.

6. The tie collar of claim 1 further comprising a pair of spaced flanges on said top wall for receiving a rail therebetween.

7. The tie collar of claim 1 wherein a plurality of webs connect said upper and lower portions.

8. The tie collar of claim 7 wherein said webs extend from the top wall to the lower portion and comprise webs extending from the edges of said side walls.

9. A railway track arrangement for supporting rails over spaced ties and ballast, said arrangement comprising a tie and a tie collar at each end of said tie, each said tie collar having an upper portion and a lower portion in a unitary rigid structure, said upper portion having a top surface for supporting a rail, a receptacle through said upper portion, each end of a tie extending through said receptacles and having vertical clearance therewith, means for restraining horizontal movement between said tie and said tie collar, said lower portion diverging outwardly from said upper portion and engaging within said ballast, said vertical clearance permitting vertical forces exerted on said arrangement to be borne substantially by said tie collar and not the tie.

10. The arrangement of claim 9 comprising a plurality of tie collars arranged in a line with the lower portions thereof in contact.

11. The arrangement of claim 9 comprising a preassembled unit of a tie and a tie collar adjacent to each end of the tie.

* * * * *